United States Patent [19]

Lantz

[11] Patent Number: 4,858,397

[45] Date of Patent: Aug. 22, 1989

[54] AIR-INFLATED HYPERBOLIC PARABOLOIDAL ROOF

[75] Inventor: Paul W. Lantz, Columbus, Ohio

[73] Assignee: James A. Rhodes, Columbus, Ohio

[21] Appl. No.: 138,732

[22] Filed: Dec. 28, 1987

[51] Int. Cl.[4] ..... E04B 1/32

[52] U.S. Cl. ..... 52/80; 52/63

[58] Field of Search ..... 52/2 G, 2 P, 63, 80

[56] References Cited

U.S. PATENT DOCUMENTS

| | | | |
|---|---|---|---|
| 2,912,940 | 11/1959 | Baroni | 52/80 |
| 3,137,097 | 6/1964 | Zeinetz | 52/80 |
| 3,772,836 | 11/1973 | Geiger | 52/63 X |
| 4,320,603 | 3/1982 | Kirschen | 52/18 |

*Primary Examiner*—Henry E. Raduazo
*Assistant Examiner*—Creighton Smith
*Attorney, Agent, or Firm*—Antonelli, Terry & Wands

[57] ABSTRACT

An air-inflated fabric roof of hyperbolic paraboloidal shape including a cable network therein and covering a building or other structure, or a part of a building such as an atrium. The building includes an annular rigid outer structure enclosing an inner area covered by the air-inflated hyperbolic paraboloidal fabric roof having the cable network therein. A pressurization system maintains the building interior at a predetermined pressure above ambient atmospheric pressure to inflate the fabric roof. The cable network includes a rigid, continuous ring member connected to the annular rigid outer structure. A first set of cables extends across the central opening of the ring member in parallel in a first or X direction. A second set of cables extends across the central opening in parallel in a second or Y direction substantially perpendicular to the first direction. The cables are tensioned so that their points of intersection lie in a hyperbolic paraboloidal surface having the general equation $$Z = \frac{X^2}{a^2} - \frac{Y^2}{b^2}.$$

Two tie cables extend diagonally across the central opening of the ring member and lie in the Z=O plane. The fabric material is fastened to the cable network. The hyperbolic paraboloidal cable network provides support for the fabric roof even in the absence of air pressurization or in the presence of large loads on the roof, for example a heavy layer of snow.

10 Claims, 3 Drawing Sheets

AIR-INFLATED HYPERBOLIC PARABOLOIDAL ROOF

FIELD OF THE INVENTION

The present invention pertains to an air-inflated fabric roof of hyperbolic paraboloidal shape including a cable network therein for covering a building or other structure, or a part of a building such as an atrium. The roof of the present invention is substantially self-supporting, even with loads thereon and even in the event of insufficient air pressurization within the building to support the roof.

BACKGROUND OF THE INVENTION

Buildings having an enclosed courtyard or atrium can be made more usable, particularly during extreme weather conditions, by having a fabric roof over the atrium. Air-supported fabric roofs have been incorporated into various buildings, for example department stores and schools, and have also been utilized on other structures such as sports stadiums. The publication "Architectural Fabric Structures", Publication No. E36347, from DuPont Company, Fluoropolymers Division, Polymer Products Department, Wilmington, Delaware, shows several such structures, as does the publication "Creating New Environments with Fiberglas, Fabric Structures," Publication No. 5-FS-9789 from Owens-Corning Fiberglas Corporation, Toledo, Ohio (1980).

Fabric roofs are very light in weight, relatively inexpensive, durable, and energy efficient. In addition, fabric roofs pass enough sunlight to permit plants to grow and to provide a pleasant environment even during cold weather.

Air-supported fabric roofs have been of a generally convex shape when viewed from above. Numerous buildings having roofs of various generally convex shapes are depicted in the publication "Architectural Fiberglas Fabric Structures," Publication No. 1-FS-8188-E, from Owens-Corning Fiberglas Corp. of Toledo, Ohio (1982). That same publication points out the general design and construction techniques for such roofs and the problems that must be overcome to successfully use the roofs.

One of the significant problems with air-supported roofs is that, should the air inflation system fail, the roof sags downwardly. Even if sagging of the roof does not present a danger to people, plants, and other objects beneath the roof, still sagging of the roof is likely to damage the roof itself, especially where the roof is supporting a load such as snow. Even the incorporation of a cable restraint, as discussed in the above-mentioned Owens-Corning Fiberglas Corp. Publication No. 1-FS-8188E, does not prevent significant sagging of an air-supported roof, with potentially disastrous results, when the air inflation system fails.

Roofs having a hyperbolic paraboloidal shape offer unique advantages, particularly in covering large areas. Roofs having this shape are substantially self-supporting. Further, over large open spaces of a fixed area, such as courtyards or sports arenas, roofs having a hyperbolic paraboloidal shape may reduce the interior volume by as much as 45% compared with convex roofs, thereby substantially reducing the heating, lighting and other energy costs. This reduced volume is taken from the upper portion of the enclosed space which generally is not utilized, and so the reduced volume does not detract from the usefulness of the structure. Additional advantages of such roofs are described in, for example, the article "Calgary Saddles Up Arena" appearing at pages 50 and 51 of the Dec. 22, 1983 issue of *Engineering News Record.*

SUMMARY OF THE INVENTION

The present invention is an air-inflated fabric roof for a building or other structure, or for a part of a building, the roof having a hyperbolic paraboloidal shape, and including a cable network within the roof, thereby substantially maintaining the hyperbolic paraboloidal shape regardless of loads on the roof and even in the event of the loss of air pressure. The building might be a residential apartment building, a commercial, professional, or business office building, a sports stadium, or another type of structure. In accordance with the present invention, the building includes a surrounding rigid outer structure enclosing an inner area covered by the air-inflated hyperbolic paraboloidal fabric roof having the cable network therein.

When the building is a residential, commercial or office building, the outer structure has a continuous outer wall in a concentric, spaced relationship to a continuous inner wall, and a first roof, which can be a conventional, substantially rigid roof, bridges the concentric walls, with the building totally enclosing an atrium. The building area between the outer and inner walls may have a plurality of floors with separate apartments or offices. Fenestrations through the inner wall provide access to the atrium which is covered by the air-inflated fabric roof. U.S. Pat. Nos. 4,608,785, issued Sept. 2, 1986, 4,637,176, issued Jan. 20, 1987, and 4,696,133, issued Sept. 29, 1987, the disclosures of which are incorporated herein by reference, show examples of such buildings. In another preferred embodiment, the building may be a sports stadium having a substantially continuous outer wall enclosing a seating area and a playing area, with an air-inflated fabric roof over the seating area and the playing area.

By way of example, the roof may be a translucent, coated glass fiber fabric, with a cable network incorporated therein A pressurization system maintains the building interior at a predetermined superatmospheric pressure to inflate the fabric roof without significantly distorting it. Air locks are provided at the entrances and exits of the building to maintain the pressurization as people enter and exit. The air maintenance system may also include conventional heating, air conditioning, humidity control, air filtration, and ventilation sub-systems.

The cable network includes a rigid, continuous ring member connected to one wall of the outer structure, or possibly to the rigid roof of the building. A first set of cables extends across the central opening of the ring member in parallel in a first direction. A second set of cables extends across the central opening in parallel in a second direction substantially perpendicular to the first direction. Each cable of the second set intersects each cable of the first set and is preferably secured thereto by clamps or the like. The ends of the cables are connected to the rigid, continuous ring member, and the cables are tensioned to cause the points defined by the cable intersections to lie in a hyperbolic paraboloidal surface having the general equation $$Z = \frac{X^2}{a^2} - \frac{Y^2}{b^2}.$$

The points of connection of the cables with the ring member, and the ring member itself, likewise lie in this surface.

The geometry of the rigid, continuous ring member is defined by four parabolic curves having points tangent to an imaginary parallelogram enclosing the ring member top plan view. Two diagonal tie cables extend across the ring member to connect the two diagonally opposite pairs of points corresponding to the tangents of the ring member plan with such imaginary parallelogram, and the tie cables lie in the X-Y plane, i.e. the Z=O plane. The fabric material is fastened to the hyperbolic paraboloidal cable network which provides support for the fabric roof even in the absence of inflating air pressure under the roof or in the presence of large loads upon the roof, for example a heavy layer of snow.

BRIEF DESCRIPTION OF THE DRAWINGS

These and other aspects and advantages of the present invention are more apparent in the following detailed description and claims, particularly when considered in conjunction with the accompanying drawings in which like parts bear like reference numerals. In the drawings:

DESCRIPTION OF PREFERRED EMBODIMENTS

Figure 1:
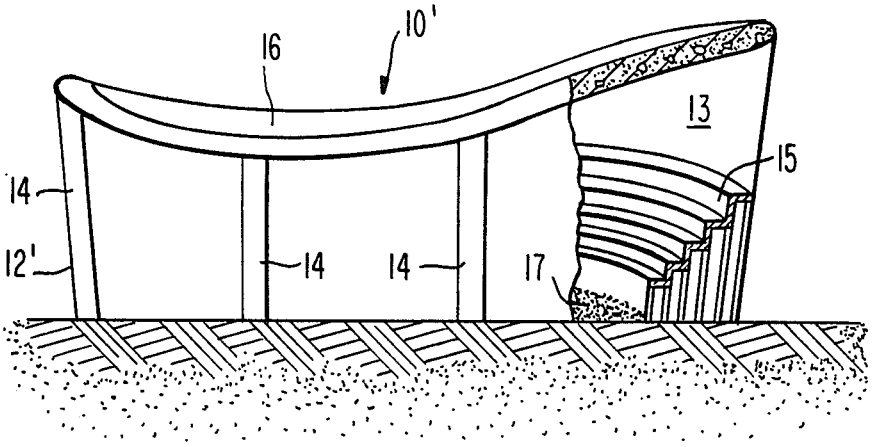
FIG. 1 is a perspective view, partially broken, depicting a structure having an air-inflated fabric roof in accordance with the present invention.

FIG. 1 depicts a structure 10', such as a sports arena, including a rigid outer structure 12' having a plurality of upright support columns 14. Outer structure 12' and support columns 14 enclose an interior portion 13 of structure 10', which in a sports arena as depicted in FIG. 1 might include a seating area 15 and a playing area 17. Interior portion 13 is covered by an air-inflated fabric roof 16 having a hyperbolic paraboloidal shape in accordance with the present invention.

Figure 2:
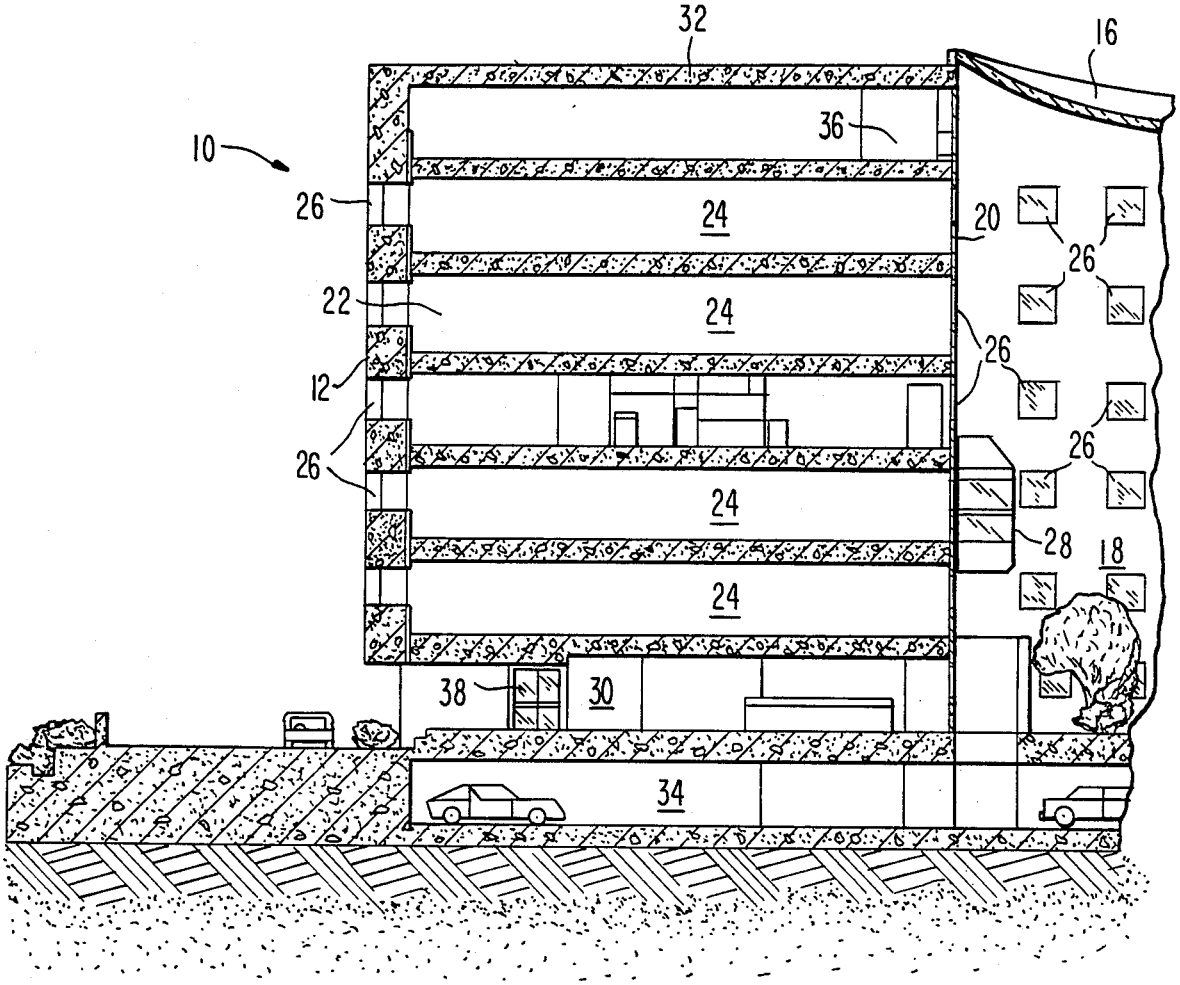
FIG. 2 is a fragmentary, sectional view of another structure having an air-inflated fabric roof in accordance with one the present invention.

FIG. 2 is a cutaway, sectional view of another structure 10 having an air-inflated fabric roof 16 of hyperbolic paraboloidal shape covering an atrium 18. Structure 10 is depicted as a residential, office, or commercial building, which could be a condominium. Building 10 includes a rigid outer wall 12 and a rigid inner wall 20 defining a building interior 22. As depicted in FIG. 2, interior 22 can have a number of floors 24 each of which is divided into a number of residential, office, or commercial units. Outer wall 12 and inner wall 20 of building 10 are provided with fenestrations such as windows 26 giving a view to the outside and into atrium 18 respectively. Access to each floor 24 within building 10 is provided by an elevator 28 which also provides access to the building lobby 30. As seen in FIG. 2, outer wall 12 and inner wall 20 are bridged by a rigid roof 32. Subterranean level 34 provides, for example, a parking area beneath building 10.

Each building 10, 10' provides a protected environment within which the temperature, humidity, and air pressure are controlled, for example by an environmental maintenance system 36, including heating, cooling or air conditioning, humidifying and dehumidifying, air pressurization, and air filtration subsystems. Spent air is exhausted from building 10 through small opening therein or through a vent (not shown). Since the pressure within the building is maintained above the outside ambient pressure, no air and/or pollutants enters the building through these openings. Further description of the present invention will be with particular reference to building 10 but is equally applicable to building 10'.

The air pressurization sub-system within environmental maintenance system 36 maintains the internal pressure within building 10 at a preselected level calculated to inflate fabric roof 16 while insuring a comfortable environment for the occupants of the building. Such predetermined pressurization level safely inflates roof 16 even in the presence of predictable loads such as snow on the roof, while not being so great as to significantly distort the shape of the roof 16. To prevent a large rush of wind as people enter and leave building 10, the building is provided with suitable air locks, such as revolving door 38 in building lobby 30.

Figure 3:
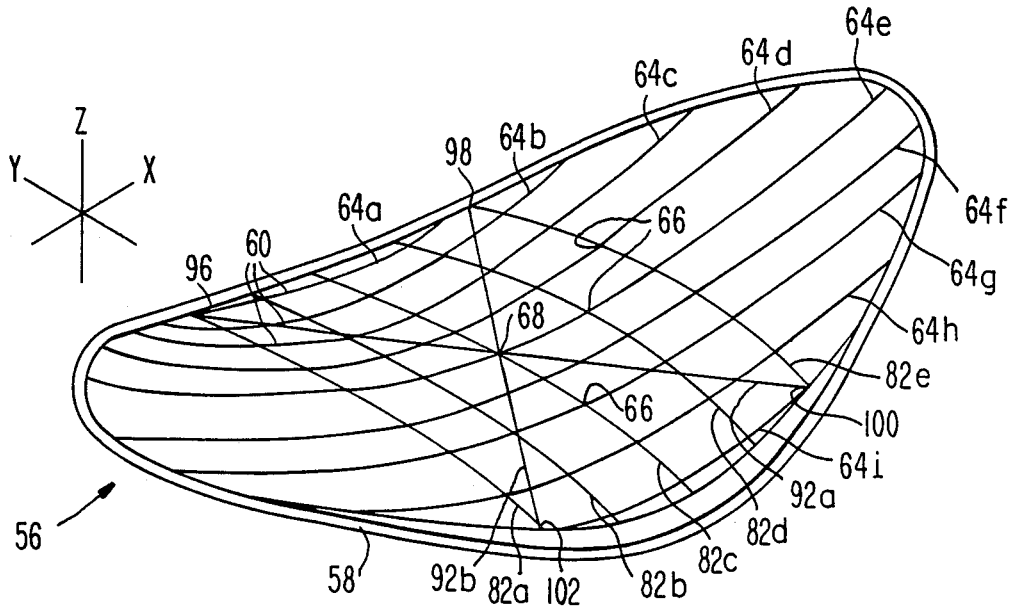
FIG. 3 is a perspective view of a cable network suitable for incorporation into an air-inflated fabric roof in accordance with the present invention.
Figure 4:
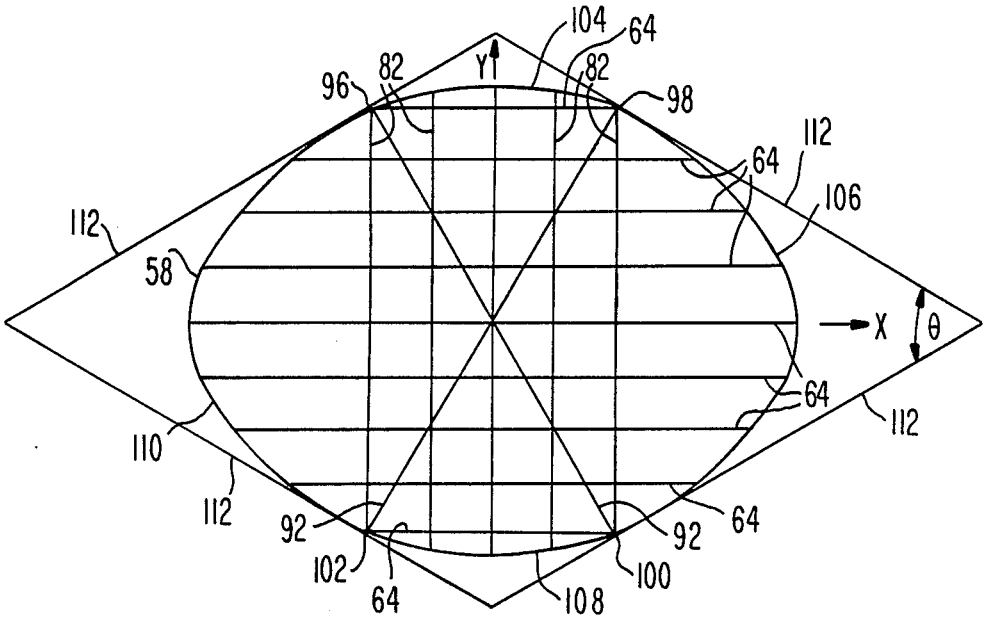
FIGS. 4 and 5 are geometric drawings useful in explaining the construction of the cable network of the present invention.

FIG. 3 is a perspective view of a cable network 56 suitable for incorporation into an air-inflated fabric roof, such as roof 16, in accordance with the present invention, while FIG. 4 is a geometric top plan view of that cable network. Cable network 56 includes a ring member 58 and a plurality of cables 60 bridging between particular points along the periphery of ring member 58. As depicted in FIG. 3, ring member 58 and cables 60 define a curved surface constituting a portion of a hyperbolic paraboloid, having the general equation:

$$Z = \frac{X^2}{a^2} - \frac{Y^2}{b^2}. \qquad [A]$$

In equation [A], X, Y and Z designate distances from the origin in the directions of the X, Y, and Z coordinate axes, respectively, while a and b are constants. The surface is symmetrical with respect to the Y-Z and X-Z planes and symmetrical to the Z axis. Such a hyperbolic paraboloidal surface includes a "saddle" shaped portion in the vicinity of the origin and extends infinitely outwardly therefrom. Ring 58 member and cables 60 are within the saddle portion of the hyperbolic paraboloidal surface.

Ring member 58 is preferably constructed from concrete, steel,- or concrete reinforced with steel to have sufficient strength to support the weight of the roof 18, even during an absence of inflating interior pressure and in the presence of substantial loads on the roof such as a layer of snow Cables 60 include a set of sagging cables 64*a*, 64*b*, 64*c*, 64*d*, 64*e*, 64*f*, 64*g*, 64*h* and 64*i*. The sagging cables 64 hang parallel to each other and to the XZ plane. Cables 60 further include a set of hogging cables 82*a*, 82*b*, 82*c*, 82*d*, and 82*e* which similarly hang parallel to each other and to the YZ plane. The sagging cables 64 and the hogging cables 82 are thus substantially perpendicular to each other. Diagonal tie cables 92*a* and 92*b* anchor to ring member 58 at points 96 and 100 and points 98 and 102, respectively. The diagonal cables 92 lie in the X-Y plane and pass through the Z axis, at the so-called "center" of the hyperbolic paraboloidal cable network 56. This center point coincides with the origin of the general equation [A].

FIG. 4 is a top plan view of ring member 58. As there depicted, ring member 58 is formed of four sections 104, 106, 108 and 110 each of which is a parabolic curve. Parabolic curves 104–110 are tangential to an imaginary parallelogram 112 which is drawn around and tangent to the ring top plan view at tangent points 96, 98, 100 and 102. Skew angle $\theta$ of parallelogram 112 may be varied in accordance with different parallelogram plans. It is preferable that $\theta$be an angle less than 90° to avoid a hyperbolic paraboloid of square plan, thereby providing increased strength.

The number of cables 64 and 82 within cable network 56 is determined by the total force required to support roof 16, which, in turn, is dependent on the weight of the roof, the snow or other loads anticipated on top of the roof, and the weight of any fixtures such as lights or loudspeakers that might be suspended from the roof. The spacing of the cables depends upon the number of cables. Preferably, an odd number of sagging cables 64 and an odd number of hogging cables 82 are utilized. The outermost sagging cables 64a and 64i are connected to ring member 58 at tangent points 96 and 98 and at tangent points 100 and 102, respectively. The intermediate sagging cables **64*b*–64*h* are connected to ring member 58 to divide the spacing between cables 64*a* and 64*i* into equal sections. Likewise, the outermost hogging cables 82a and 82e are connected to ring member 58 at tangent points 96 and 102 and at tangent points 98 and 100, respectively, and the intermediate hogging cables 82*b*–82*d* are connected to ring member 58 to divide the spacing between cables 82*a* and 82*e* into equal sections. Ring member 58 must be of sufficient cross section that the resultant forces from cables 60** remain within the ring member under all anticipated load conditions.

The sagging cables 64 and the hogging cables 82 intersect at intersection points 66 (FIG. 3). At each intersection point 66 the sagging cable and the hogging cable are connected together by conventional clamps and sleeves. Diagonal tie cables **92*a* and 92*b* are connected to each other by conventional clamps or sleeves at the center point 68. If desired, the diagonal cables 92 may also be connected to either sagging cable 64*e* or the hogging cable 82*c* or both at center point 68**.

During construction of cable net 56, the cables 64 and 82 are tensioned to achieve the hyperbolic paraboloidal shape shown in FIG. 3. Under such tensioning, the sagging cables 64 have their highest elevation at their anchoring points with ring member 58 and their lowest vertical orientation at hogging cable 82c which passes through center point 68. Conversely, the hogging cables 82 have a maximum elevation at sagging cable **64*e* which passes through center point 68 and their lowest orientation at the points where they anchor to ring member 58. Diagonal tie cables 92 and 94** lie substantially in the X-Y (i.e., Z=O) plane and so do not appreciable sag or hog.

Flexible fabric material is attached to cable network 56 to form roof 16. One suitable technique for attaching the fabric material to the cable network is the large, two-way cable clamping system depicted on page 14 of the aforementioned Owens-Corning Fiberglas Corp. publication "Architectual Fiberglas Fabric Structures." Fabric panels are attached between cables. Because of its hyperbolic paraboloidal shape, cable network 56 is self supporting, and the elevated air pressure within building 10 merely inflates the fabric material, causing the material to bulge slightly in the spaces between adjacent cables.

When a heavy load such as snow is on roof 16, or when there is insufficient pressure within building 10 to fully inflate roof 16, the downward load tends to stretch or tension sagging cables 64 and compress or shorten hogging cables 82. Ring member 58 thus tends to shorten in the direction of the X axis and to widen in the direction of the Y axis. Diagonal tie cables 92 lie beneath the sagging cables 64 and the hogging cables 92 and are not subjected to the downward load. Cables 82 inhibit the distortion of ring member 58, retaining the ring member in acceptable dimensions. Ring member 58 must be of sufficient cross section that the resultant forces from cables 60 fall within the ring member. Hogging cables 82 continue to rise and sagging cables continue to sag, and so roof 16 retains substantially the same hyperbolic paraboloidal shape. The fabric of roof 16 sags slightly between adjacent cables.

Figure 5:
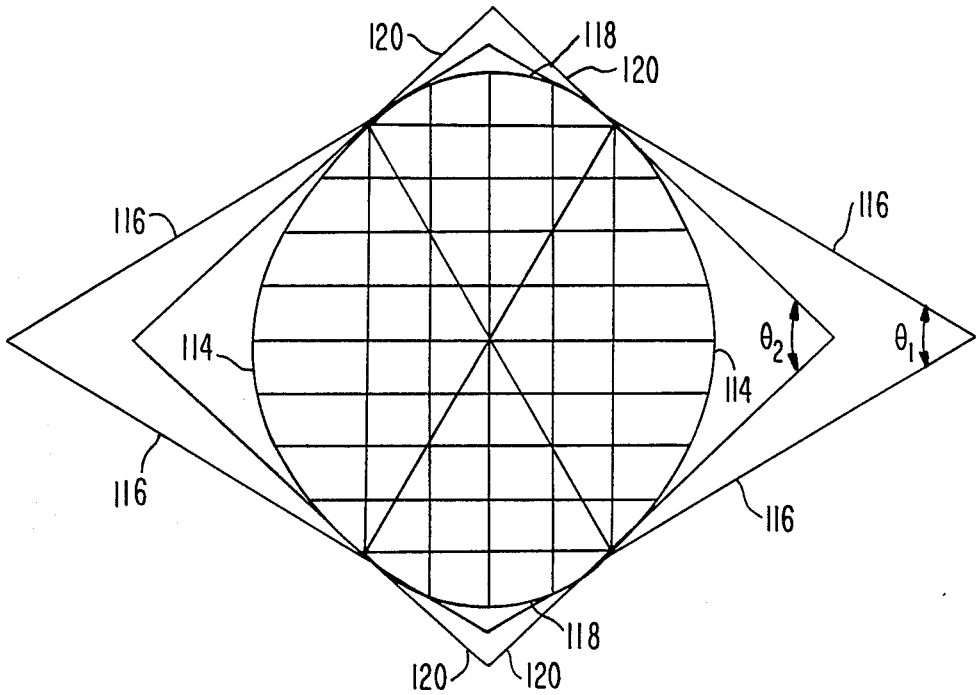

FIGS. 3 and 4 illustrate the cable network for roof 16 as formed within a single parallelogram 112. As illustrated in FIG. 5, a variation is to define two opposite curves 114 as tangent to a first parallelogram 116 having a skew angle $\theta_1$ and the other two opposite curves 118 tangent to a second parallelogram 120 having a skew angle $\theta_2$. Skew angle $\theta_2$ must be greater than $\theta_2$, in which case the cable network is wider than it otherwise would be, as depicted in FIG. 5, or more nearly square than the elongated shape of FIG. 4. The parabolic curves need to be entirely within the area commonly described within the two parallelograms. The optimum shape will be determined by the magnitude of the loads.

Although the present invention has been described with reference to preferred embodiments, numerous modifications, rearrangements, and substitutions could be made, and the result would remain within the scope of the invention.

What is claimed is:

1. A cable network for an air inflated fabric roof comprising:

a substantially rigid ring member having a geometric plan lying within and tangent to a non-square parallelogram;

a first set of cables extending across said ring member in parallel in a first or X direction with both ends of each cable of said first set of cables connected to said ring member;

a second set of cables extending across said ring member in parallel in a second or Y direction substantially perpendicular to the X direction, with both ends of each cable of said second set of cables connected to said ring member, each cable of said second set of cables intersecting each cable of said first set of cables, with the resulting intersections and said ring member defining a single saddle portion of a hyperbolic paraboloidal surface satisfying the equation $$Z = \frac{X^2}{a^2} - \frac{Y^2}{b^2},$$

where X is the distance in the X direction from an origin point, Y is the distance in the Y direction from the origin point and Z is the distance from the origin point in the Z direction, perpendicular to both the X direction and the Y direction;

a pair of tie cables, extending diagonally with respect to said first and second sets of cables and lying in the Z=O plane, with the cable ends of said tie cables connected to said ring member.

2. A cable network as claimed in claim 1 wherein said tie cables are attached to said ring member at the tangent points of the parallelogram with the ring member plan.

3. A cable network as claimed in claim 2 wherein the cable ends of the outermost cables extending in the X direction and the cable ends of the outermost cables extending in the Y direction are connected to said ring member at the tangent points.

4. A cable network as claimed in claim 3 wherein each of said first and second cable sets includes an odd number of substantially equally spaced-apart cables to provide an even number of substantially equal spaces therebetween.

5. A cable network as claimed in claim 1 further comprising a flexible fabric membrane extending between adjacent cables and between said ring member and the cables closest thereto to provide a fabric membrane roof.

6. A cable network as claimed in claim 5 wherein said fabric membrane is translucent.

7. A cable network as claimed in claim 5 further comprising:

a rigid wall structure forming the sides of an annular structure having a central area therewithin, with said ring member on the top of said wall structure to cover the central area with said fabric membrane and said cables; and an air maintenance system including means for admitting air into the structure at a predetermined superatmospheric pressure.

8. A cable network as claimed in claim 7 further comprising:

an annular seating area within said structure; and a playing area within said annular seating area.

9. A cable network as claimed in claim 7 wherein said structure includes an annular outer wall, an annular inner wall within and spaced from said outer wall, an annular roof covering the space between said inner and outer walls, and a plurality of interior walls between said outer wall and inner wall and beneath said annular roof to define a plurality of rooms within said structure.

10. A cable network as claimed in claim 9 wherein said structure further includes a plurality of floors between said outer wall and inner wall and beneath said annular roof to define a multi-floor building within said structure.

* * * * *